US007097520B2

(12) United States Patent
Okumura et al.

(10) Patent No.: US 7,097,520 B2
(45) Date of Patent: Aug. 29, 2006

(54) STEERING SYSTEM FOR SMALL BOAT

(75) Inventors: Takashi Okumura, Tokyo (JP); Koichiro Awano, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 21 days.

(21) Appl. No.: 11/056,389

(22) Filed: Feb. 14, 2005

(65) Prior Publication Data

US 2005/0181687 A1 Aug. 18, 2005

(30) Foreign Application Priority Data

Feb. 17, 2004 (JP) ..... 2004-039287

(51) Int. Cl.
*B63H 25/04* (2006.01)

(52) U.S. Cl. ..... 440/1; 114/144 R

(58) Field of Classification Search ..... 114/144 E, 114/144 R; 440/1
See application file for complete search history.

(56) References Cited

U.S. PATENT DOCUMENTS 4,366,768 A * 1/1983 Kulischenko et al. .... 114/144 E
4,573,545 A * 3/1986 Kalns ..... 180/404
4,716,983 A * 1/1988 Adams et al. ..... 180/446
6,892,662 B1 * 5/2005 Watanabe et al. ..... 114/144 R

FOREIGN PATENT DOCUMENTS

JP 2652788 5/1997

* cited by examiner

*Primary Examiner*—Stephen Avila
(74) *Attorney, Agent, or Firm*—Rabin & Berdo, PC

(57) ABSTRACT

A cylinder unit is provided in a rear side of a boat body to rotate an outboard motor main body as a steering apparatus, and a pump unit is provided to drive the pump unit via a hydraulic pipe by a steering wheel in a driver's seat. A steering torque inputted to the pump unit by the steering wheel is detected by a torque sensor. The pump unit is assisted in the steering operation direction based upon the detected torque by an electric motor, a worm gear, and a worm wheel.

7 Claims, 10 Drawing Sheets

STEERING SYSTEM FOR SMALL BOAT

BACKGROUND OF THE INVENTION

1. Field of the Invention

The present invention relates to a steering system for a small boat.

2. The Related Art of the Invention

As a steering system for a conventional small boat such as a boat with an outboard motor, there has been proposed a steering system in which a power is assisted by an electric motor as disclosed in Japanese Patent Serial No. 2652788.

In this conventional steering system, an operation of a steering wheel located in a driver's seat is transmitted to an outboard motor steerably supported in a rear side of the boat by a wire and the outboard motor is rotated in accordance with a steering amount of the steering wheel. On the other hand, a rotating force of the electric motor in a power-assisted mechanism rotates the outboard motor through a reduction gear. Herein an output signal of a steering force sensor to sense a steering transmission force acting on the wire, a motor rotation number signal of the outboard motor and the like are detected. An assist force of the electric motor is controlled in accordance with the signals by an electric control unit.

However, since the electric motor or the steering force sensor are arranged in the vicinity of the outboard motor in the conventional steering system, there is a need for improving a water proofing property so as to prevent water rolled up by a propeller or the like from entering into the electric motor or the steering force sensor. And the mounting of them is complicated, thereby to increase costs of the steering system.

And an operating force of the wire pushed and pulled by the steering of the steering wheel is sensed by the steering force sensor. Therefore, the steering force that can be sensed by the steering force sensor reduces or varies by friction generated caused by the wire operation, deteriorating the accuracy of the sensor. As a result, the assist force is restricted and therefore, there is a limit to reducing the steering force and improving a feeling of the steering.

In view of the above, there exists a need for a steering system for a small boat which overcomes the above-mentioned problems in the related art. The present invention addresses this need in the related art and also other needs, which will become apparent to those skilled in the art from this disclosure.

SUMMARY OF THE INVENTION

The present invention, from a viewpoint of the foregoing problems, has an object of providing a steering system for a small boat, which is inexpensive and easy to steer without a consideration for water proofing property.

According to a first aspect of the present invention, a steering system for a small boat comprises, a steering apparatus rotatably arranged in the horizontal direction in a rear side of a boat body, a cylinder unit arranged in the rear side of the boat body to rotate and steer the steering apparatus, a pump unit steered by a steering wheel in a driver's seat, a pipe fluidically communicating the pump unit with the cylinder unit, a torque sensor to detect a steering torque inputted from the steering wheel to the pump unit, an electric actuator to assist-drive the pump unit, and a controller to drive the electric actuator in accordance with a steering direction based upon a detection signal of the torque sensor. As the steering system there is an outboard motor housing a rudder or a propulsion unit therein rotatably arranged in the rear side of the boat body.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Selected preferred embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
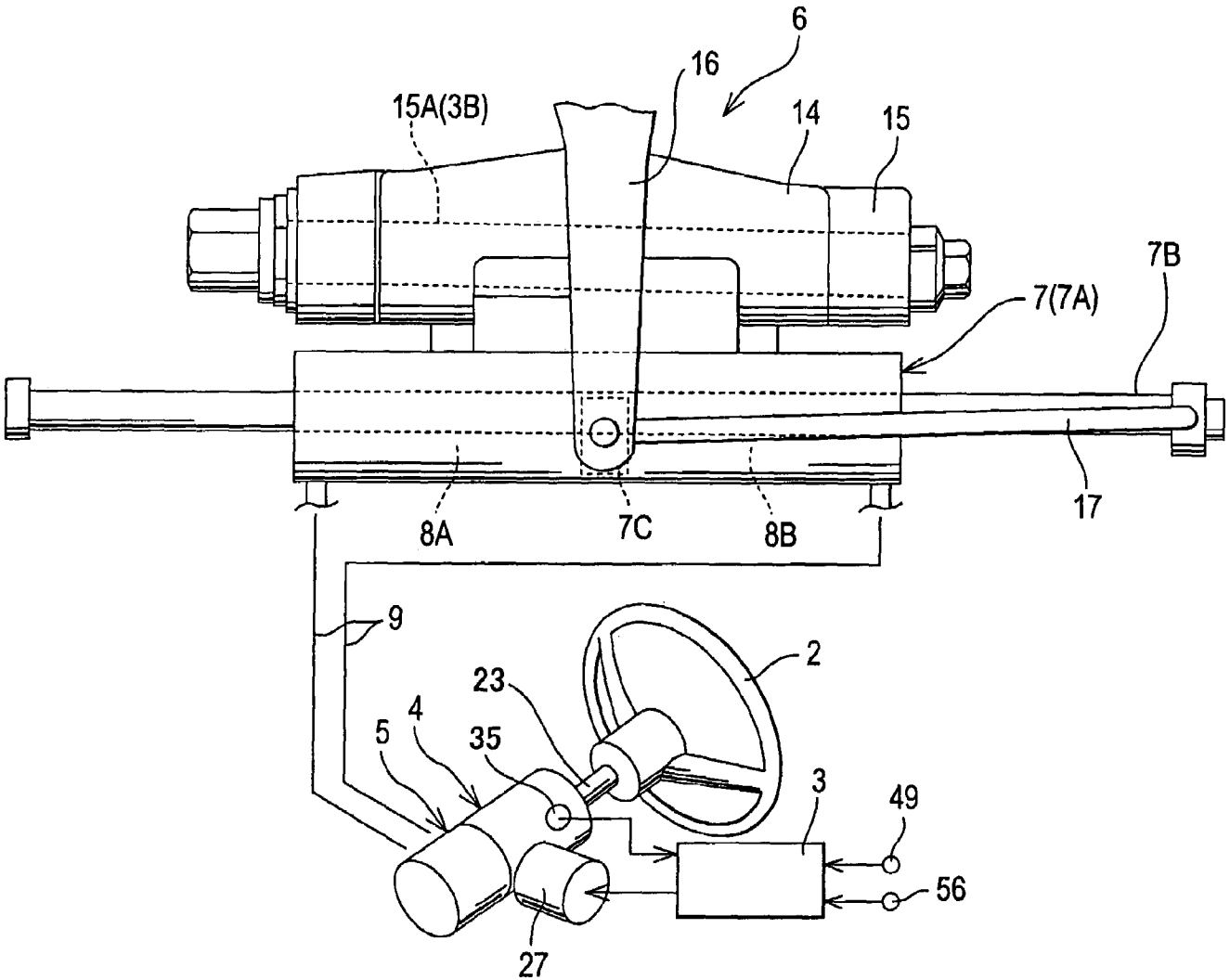
FIG. 1 is a system construction view showing a steering system for a small boat in a first preferred embodiment of the present invention.

FIG. 1 is a system construction view showing a steering system for a small boat to which the present invention is applied. An outboard motor equipped with a steering apparatus will be explained as an example of the preferred embodiment. Note that the present invention can be applied to a steering system for a small boat equipped with a rudder disposed independently of an outboard motor by using the outboard motor as an alternative to the rudder.

A steering system in the first preferred embodiment includes a steering wheel 2 disposed in a driver's seat of a boat body, a power-assisted unit 4 and a pump unit 5 which convert a steering operation of the steering wheel 2 into a hydraulic pressure, an outboard motor 6 as a steering apparatus, and a cylinder unit 7 disposed in a rear side of a boat body to which the outboard motor 6 is mounted to rotate the outboard motor 6 in accordance with a hydraulic pressure. Further, a controller (ECU) 3 to control the power-assisted unit 4 is provided. The ECU 3 is composed of a microprocessor, a RAM, a ROM, I/O interfaces, and the like.

Figure 2:
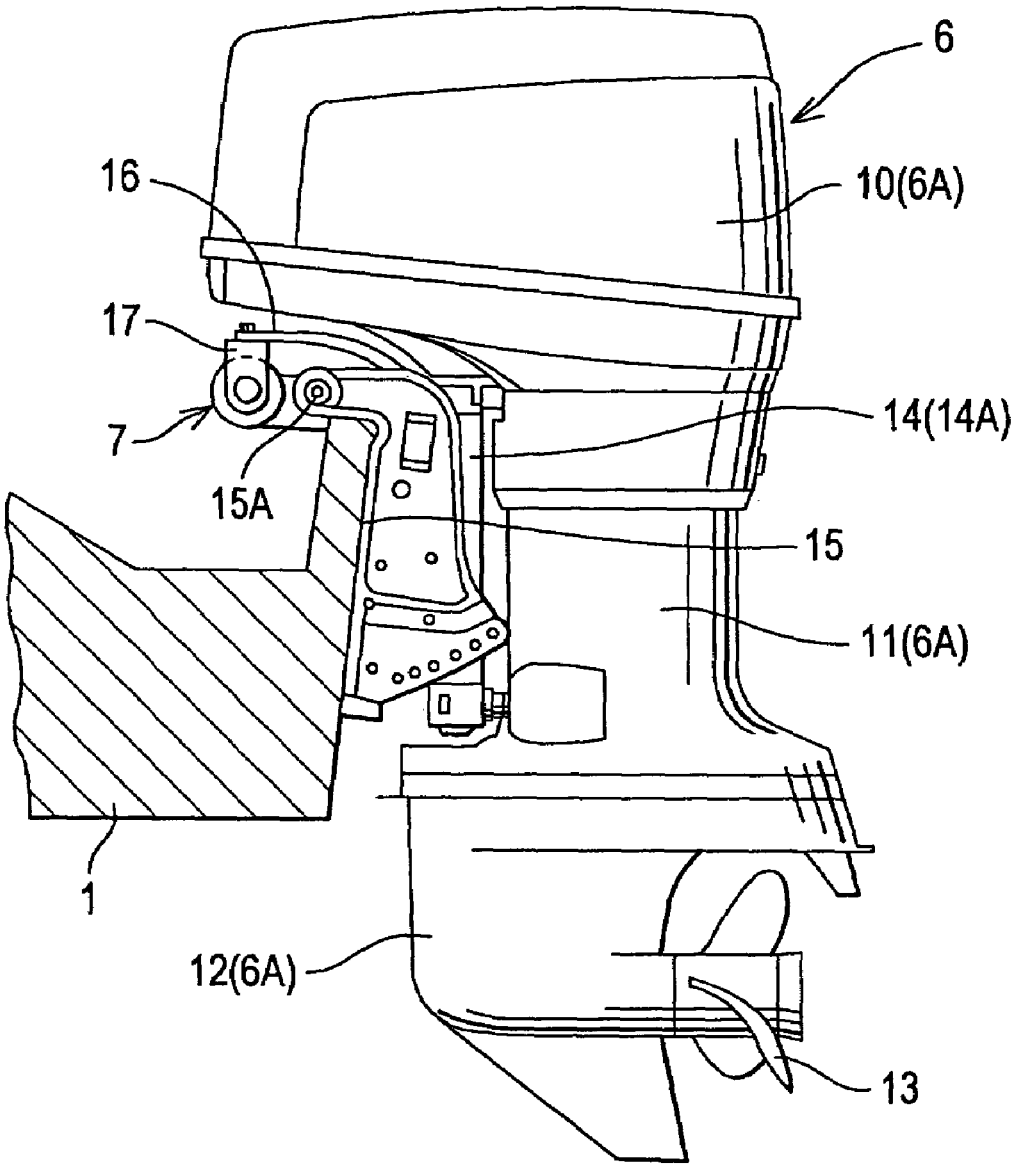
FIG. 2 is a side elevation view showing an outboard motor as a steering apparatus in the first preferred embodiment.

FIG. 2 shows the outboard motor 6 which is provided with an outboard motor main body 6A driving a propeller 13, which produces a propelling force for a small boat by rotation of the propeller 13. The outboard motor main body 6A transmits a rotation of an engine mounted to an engine housing 10 through a drive shaft inside a drive shaft housing 11 and a bevel gear inside a gear housing 12 to the propeller 13. The outboard motor main body 6A is rotatably supported around an upward and downward axis by an axis 14A (pilot shaft) in the upward and downward direction mounted in a swivel bracket 14. A clamp bracket 15 fixed to a boat body 1 supports the swivel bracket 14. The clamp bracket 15 grips a transom of the boat body 1 through an axis (clamp bracket shaft) 15A in the horizontal direction. The swivel bracket 14 and the outboard motor main body 6A can jump up in the counter clockwise direction seen from a side view of the boat.

FIG. 1 shows the cylinder unit 7 which is provided with a rod cylinder 7A fixed to the swivel bracket 14, a steering bracket 16 fixed to the outboard motor main body 6A and extending in a side of the boat body 1 and a drag link 17 connecting the steering bracket 16 to an end of a piston rod 7B of the rod cylinder 7A. The rod cylinder 7A is provided with the piston rod 7B slidably supported therein, and the piston rod 7B is provided with a piston 7C traveling together therewith. The piston 7C divides an inside of the rod cylinder 7A into two cylinder chambers 8A, 8B. The right and left cylinder chambers each are connected to a pair of discharge ports of the pump unit 5 through hydraulic pipes 9.

And the cylinder chamber 8A (or 8B) into which the hydraulic pressure is supplied from the pump unit 5 is expanded to move the piston 7C and piston rod 7B. This movement is transmitted through the drag link 17 to the steering bracket 16. And the outboard motor main body 6A rotates around the axis 14A in the upward and downward directions for being steered. On the other hand, the other cylinder chamber 8B (or 8A) is compressed to discharge the operating fluid. The discharged fluid is sucked in the pump unit 5 through the hydraulic pipe 9.

Figure 3:
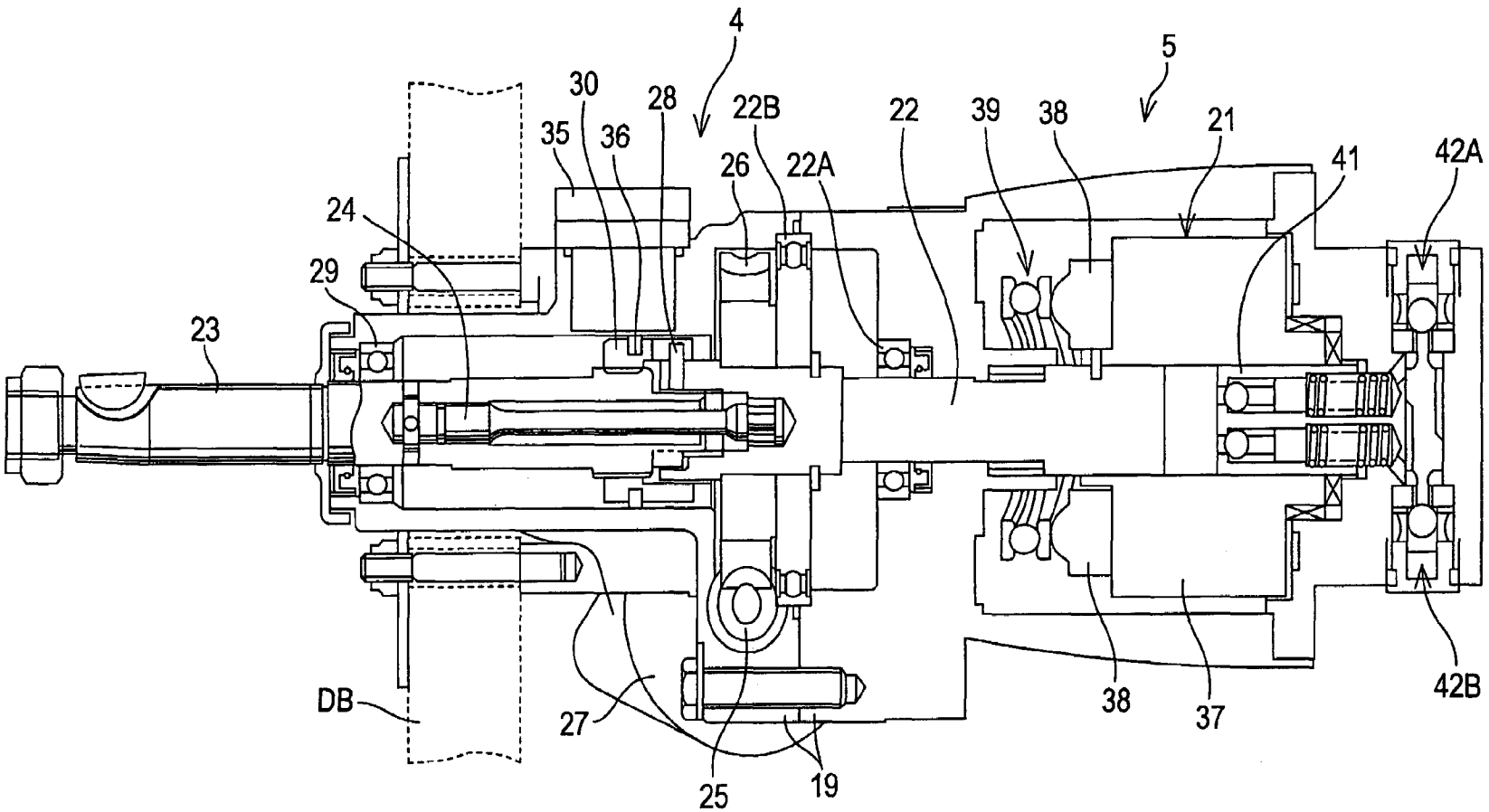
FIG. 3 is a cross sectional view showing a power-assisted unit and a pump unit for the steering system in the first preferred embodiment.

The power-assisted unit 4 is provided with a detector to detect a steering torque given to the steering wheel 2. The power-assisted unit 4 rotates and drives the pump unit 5 based upon an assist force in accordance with the detected steering torque through an output shaft. The pump unit 5 sucks in a hydraulic oil from one port and discharges the hydraulic oil from the other port depending upon the rotation direction to activate the cylinder unit 7. The power-assisted unit 4 and the pump unit 5 are formed integrally as shown in FIG. 3. The constructions of the power-assisted unit 4 and the pump unit 5 will be explained hereinafter.

The power-assisted unit 4 is provided with a steering shaft 23 connected to the steering wheel 2, an output shaft 22 connected through a torsion bar 24 to the steering shaft 23, and an electric motor 27 as an electric actuator to drive the output shaft 22. The electric motor 27 drives the output shaft 22 through a worm gear 25 and a worm wheel 26. The output shaft 22 is rotatably supported through a bearing 22A in a small diameter and a bearing 22B in a large diameter to a case 19. Further, the output shaft 22 is integral with the worm wheel 26 adjacent to the bearing 22B in a large diameter. A front end of the torsion bar 24 is fixed to a side (steering wheel 2) of a rear end of the output shaft 22 by serration or the like. The torsion bar 24 is connected to a front end of the steering shaft 23. And a torque pin 28 is disposed in the output shaft 22, extending in an outward direction thereof. The case 19 is bolted to the boat body.

A bearing 29 disposed in the case 19 rotatably supports the steering shaft 23 and a rear end of the steering shaft 23 is connected to the steering wheel 2. The torsion bar 24 is connected to a hollow inside of the steering shaft 23. A torque ring 30 engages with an outer surface of the steering shaft 23 by spline or serration.

Figure 4:
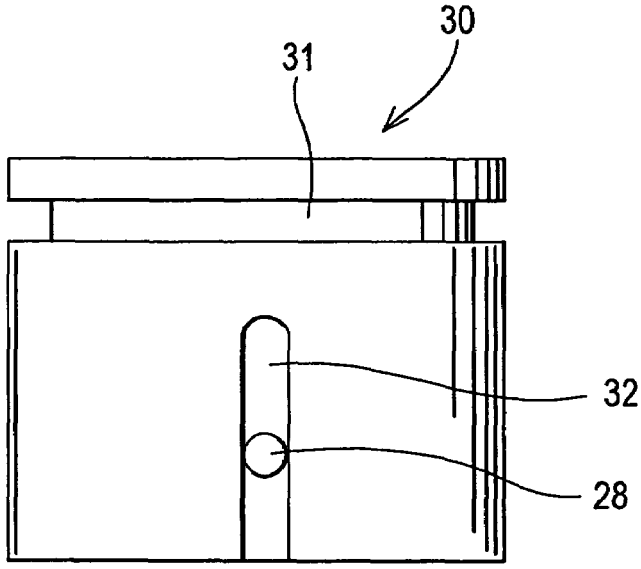
FIG. 4 is an enlarged view showing a torque ring for the steering system.

The torque ring 30 is, as shown in FIG. 4, provided with a circumferential groove 31 disposed in an outer face and an axial groove 32 engaging with the torque pin 28 of the output shaft 22. The engagement of the torque pin 28 with the axial groove 32 allows the torque ring 30 to move to and rotate with the output shaft 22 in the axial direction. The spline or the serration engaging with an outer surface of the steering shaft 23 is formed on an inner surface of the torque ring 30. A detecting pin 36 of a position-detecting unit is engaged with the circumferential groove 31. The detecting pin 36 of the position-detecting unit serves as a torque sensor 35. And the torque ring 30 moves in the axial direction in accordance with a torsion amount generated in the torsion bar 24 in operating the steering wheel 2, namely a relative rotation amount between the output shaft 22 and the steering shaft 23. The detecting pin 36 engaged with the circumferential groove 31 moves in an axial direction as a result of an axial movement of the torque ring 30. The torque sensor 35 detects the movement of the detecting pin 36 to output a steering torque in accordance with a movement amount of the detecting pin 36.

Note that the torque ring 30 is connected to the output shaft 22 to move in the axial direction by the axial groove 32 and rotate therewith by the torque pin 28. Further, the torque ring 30 is connected to the steering shaft 23 by spline or serration oblique thereto. However, the torque ring 30 may be connected to the output shaft 22 by spline or serration oblique thereto and to the steering shaft 23 to move in the axial direction and rotate therewith in the rotating direction (not shown).

Figure 5:
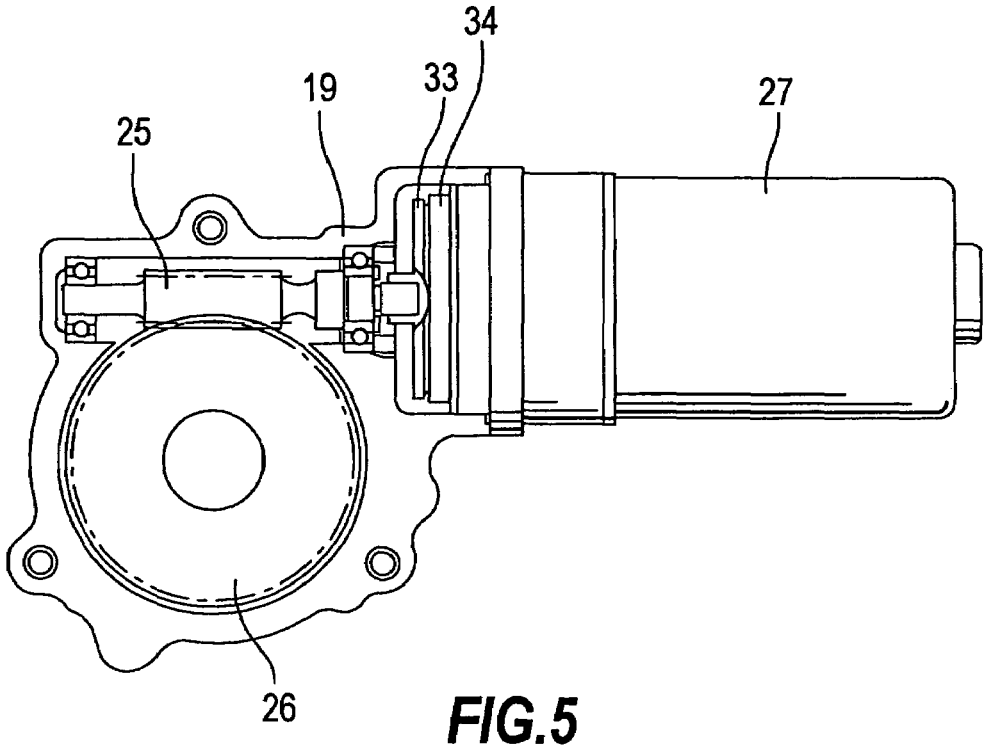
FIG. 5 is a cross sectional view showing the power-assisted unit for the steering system.

The worm wheel 26 is engaged with the worm gear 25. The worm gear 25, as shown in FIG. 5, is rotatably supported by the case 19. A clutch plate 33 is connected to one end of the worm gear 25 to move in the axial direction and rotate therewith. The clutch plate 33 is engaged with a drive plate 34 rotated and driven by an assist motor 27. When the clutch coil (not shown) is energized, the clutch plate 33 and the drive plate 34 are engaged. A driving force of the assist motor 27 is transmitted to the worm gear 25 by the engagement. On the other hand, both the plates 33 and 34 are disengaged by release of the energisation to the clutch coil. This allows the worm gear 25 and the worm wheel 26 to be released from the assist motor 27.

Namely, according to the preferred embodiment, in case the electric motor 27 is out of order, when the energisation to the clutch coil is released, the clutch plate 33 is away from the drive plate 34. As a result, at the failure of the electric motor 27, the electric motor 27 is disconnected to easily steer the output shaft 22 by the steering force of the steering wheel 2. Note that the power-assisted unit 5 is composed of the electric motor 27, the worm gear 25, and the worm wheel 26.

Figure 6:
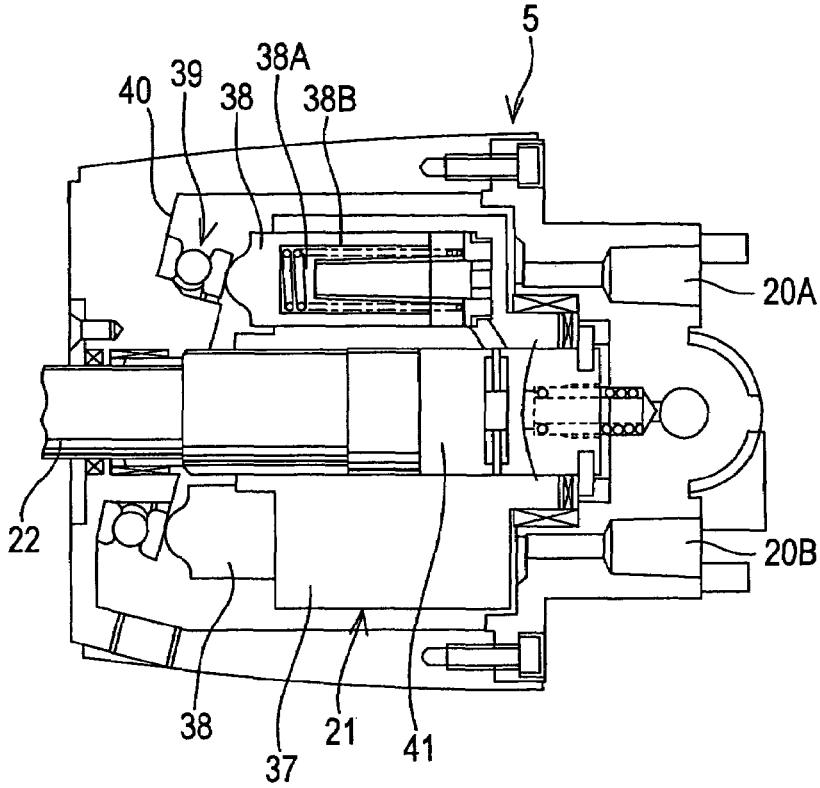
FIG. 6 is a cross sectional view showing the pump unit for the steering system.

The pump unit 5, as shown in FIGS. 3 and 6, is a displacement type pump, for example, an in-line axial piston pump 21. A pair of ports 20A, 20B for the pump unit 5 are via the hydraulic pipes 9 to each cylinder chamber 8A, 8B of the cylinder unit 7. A plurality of pistons 38 are disposed in a rotor 37 rotating with the output shaft 22 to be spaced in the circumferential direction by an equal interval. The plurality of the pistons 38 are slidably disposed in the axial direction in the rotor 37. A spring 38B is received in a piston chamber 38A formed in the piston 38. This spring 38B urges a head of the piston 38 in the axial direction, which as a result, is extended in the axial direction. And the head of the piston 38 contacts via a shoe 39 an oblique plate 40. Therefore, when the output shaft 22 and the rotor 37 rotate, the piston 38 is pushed inside by the oblique plate 40 to produce a pumping function. Namely the hydraulic oil is sucked from one port 20A (or 20B) and discharged from the other port 20B (or 20A) in accordance with the rotation direction via a passage inside a plug 41 serving as a valve plate.

Figure 7:
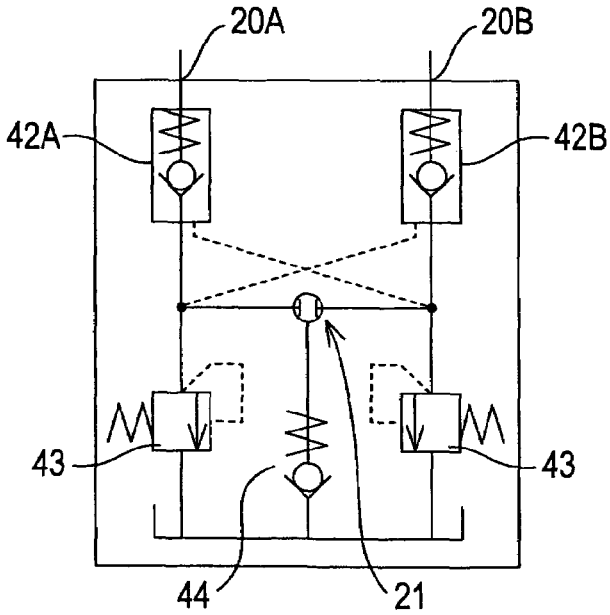
FIG. 7 is a hydraulic circuit diagram showing the pump unit for the steering system.

Pilot check valves 42A, 42B are, as shown in FIG. 7, provided respectively in the pair of the ports 20A, 20B. The pilot check valves 42A, 42B close when the pump unit 5 stops, namely when supply and discharge of the hydraulic oil are not provided. Meanwhile, when the supply and the discharge of the hydraulic oil from the pump unit 5 are provided, the check valve 42A or 42B in a discharge side is opened by the hydraulic pressure in a supply side. Note that a relief valve 43 is provided and a vacuum-securing valve 44 to prevent a supply-side port and a pump chamber from becoming a negative pressure is provided.

Figure 8:
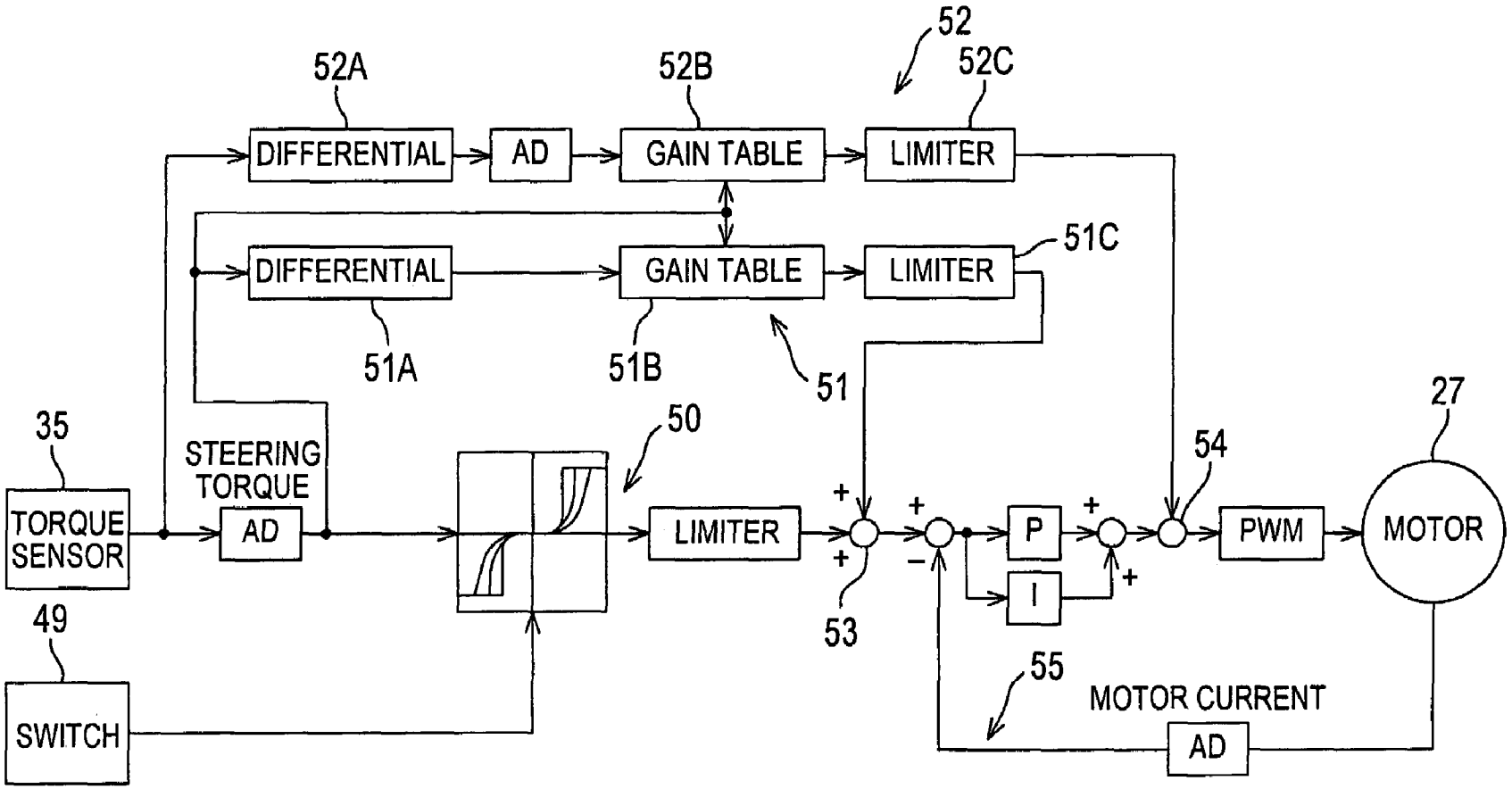
FIG. 8 is a block diagram showing a control system of an electric motor.

FIG. 8 is a block diagram showing an ECU 3 controlling the electric motor 27. The process to be executed in the ECU 3 will be explained in detail as follows. The process to be executed in the ECU 3 is provided mainly with a basic assist current determination process 50, auxiliary assist current determination processes 51, 52, auxiliary assist current addtion processes 53, 54, and a feedback process 55.

The basic assist current determination process 50 determines a first basic assist current value in accordance with a value of an output signal of the torque sensor 35, namely a magnitude of a steering torque of a coxswain. This basic assist current determination process 50 stores data in advance in an EEPROM, a CPU flash memory or a data area of a program. The basic assist current determination process 50 determines as the first basic assist current value the data with regard to an assist current value corresponding to a magnitude of a steering torque (an output signal value of the torque sensor 35). The characteristics of the first basic assist current value, as shown in FIG. 9, is composed of an area as a dead zone to an output of the torque sensor 35 and an area in proportion to a general square of the output signal value of the torque sensor 35.

Figure 9:
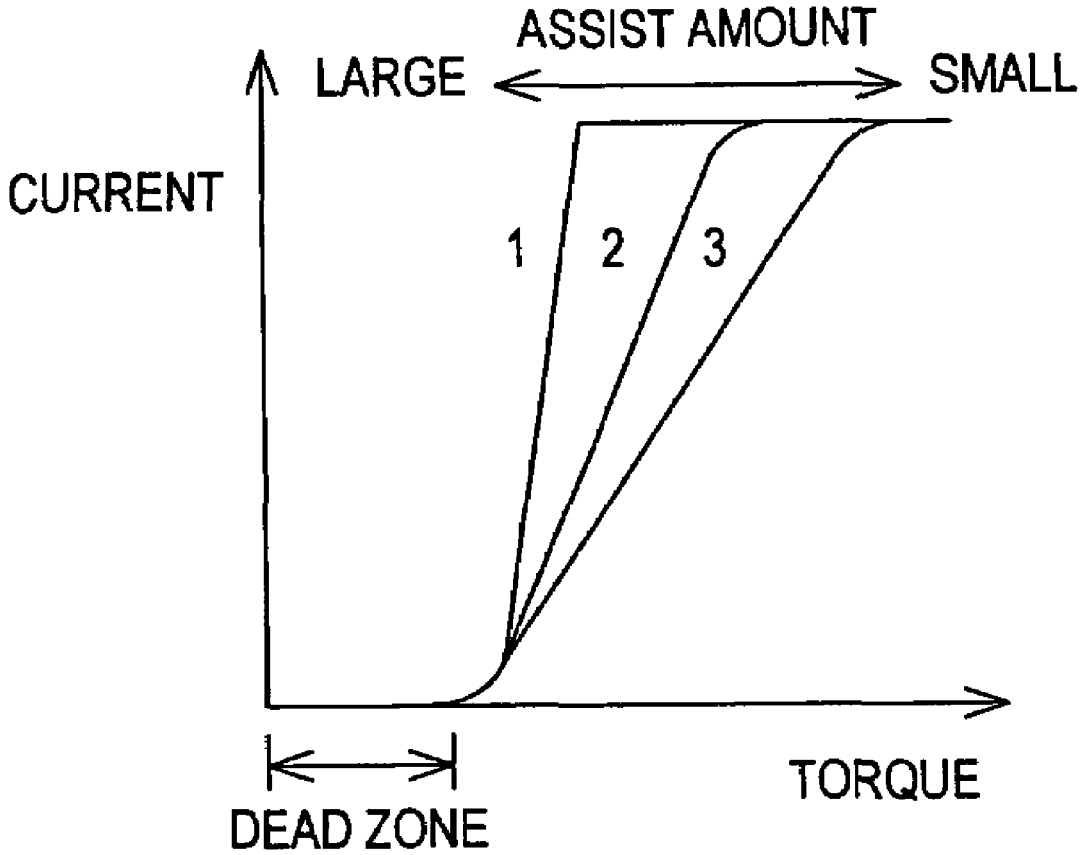
FIG. 9 is a characteristic graph showing an assist characteristic by a basic assist current value.

FIG. 9 shows three characteristics showing a relation between the steering torque and the assist current. These characteristics are not limited to the three characteristics but may be at least two characteristics. These characteristics can be selected by a switch 49 (a rotary switch or a toggle switch) disposed in the vicinity of the steering wheel 2. And these characteristics can be set based upon a diameter of a steering wheel, a magnitude of an engine output, an engine speed, and the like by a coxswain's preference.

The auxiliary assist current determination process 51 differentiates an output signal of the torque sensor 35 to correct cogging torque specific to the electric motor 27. The auxiliary assist current addition process 53 is the process in which a value of the output signal of the torque sensor 35 differentiated by the auxiliary assist current determination process 51 is added to the basic assist current value. The auxiliary assist current determination process 51 differentiates an output signal of the torque sensor 35, for example, with a digital differentiator 51A and the differentiated output signal is multiplied over a differential gain in a gain table by a multiplier 51B, and a limit is given to this value at a limit 51C, which then is outputted. Note that a differential gain at a gain table is set to vary in accordance with a steering torque value to restrict vibrations of an auxiliary output value. A second basic assist current value made by adding the output signal by the auxiliary assist current determination process 51 becomes a basic command current value to the electric motor 27.

In an auxiliary assist current determination process 52, a phase delay of the electric motor 27 is corrected by differentiating the output signal of the torque sensor 35. The auxiliary assist current addition process 54 adds the value of the output signal of the torque sensor calculated in the auxiliary assist current determination process 52 to an assist command current value at a final stage. The auxiliary assist current determination process 52 differentiates the output signal of the torque sensor 35, for example, with a digital differentiator 52A with high response and resolution and the differentiated output signal is multiplied over a differential gain in a gain table by a multiplier 52B, and a limit is given to this value at a limit 51C of a phase delay correction and a variation amount correction, which then is outputted. Note that a differential gain in a gain table is set to vary in accordance with a steering torque value to restrict vibrations of an auxiliary output value. An assist current value made by adding the output signal of the auxiliary assist current determination process 52 becomes a final command current value to a driver PWM to drive the electric motor 27.

The reasons why the differential value of the output signal of the torque sensor 35 is thus added to the first basic assist current value and to the assist current value at a final stage are as follows.

The first reason is to shorten time from a point when the torque sensor 35 detects the steering torque to a point when the assist force is transmitted from the worm gear 25 to the worm wheel 26. Namely the object is to improve response of the assist of the steering force. Accordingly, even in case the steering torque detected by the torque sensor 35 changes rapidly, the steering force can be assisted with the assist force in accordance with the changed steering torque.

The second reason is to prevent an assist current value from oscillating. The differentiation advances the phase by 90° to prevent the oscillation.

The feedback process 55 is a process to make a current value flowing in the electric motor 27 be matched to an assist current command value. Rotation of the electric motor 27 causes the electric motor 27 to generate power in the same way with a generator and produce a counter electromotive voltage, and as a result, the current value flowing in the electric motor 27 becomes small. Therefore, the assist force is reduced to be smaller than the assist force in accordance with the steering torque to deteriorate the steering feeling. In order to prevent this phenomenon, the influence by the counter electromotive voltage is reduced by feed-backing a current value flowing in the electric motor 27 to the assist current command value. Thereby the motor current value becomes matched to the assist current command value.

Figure 10:
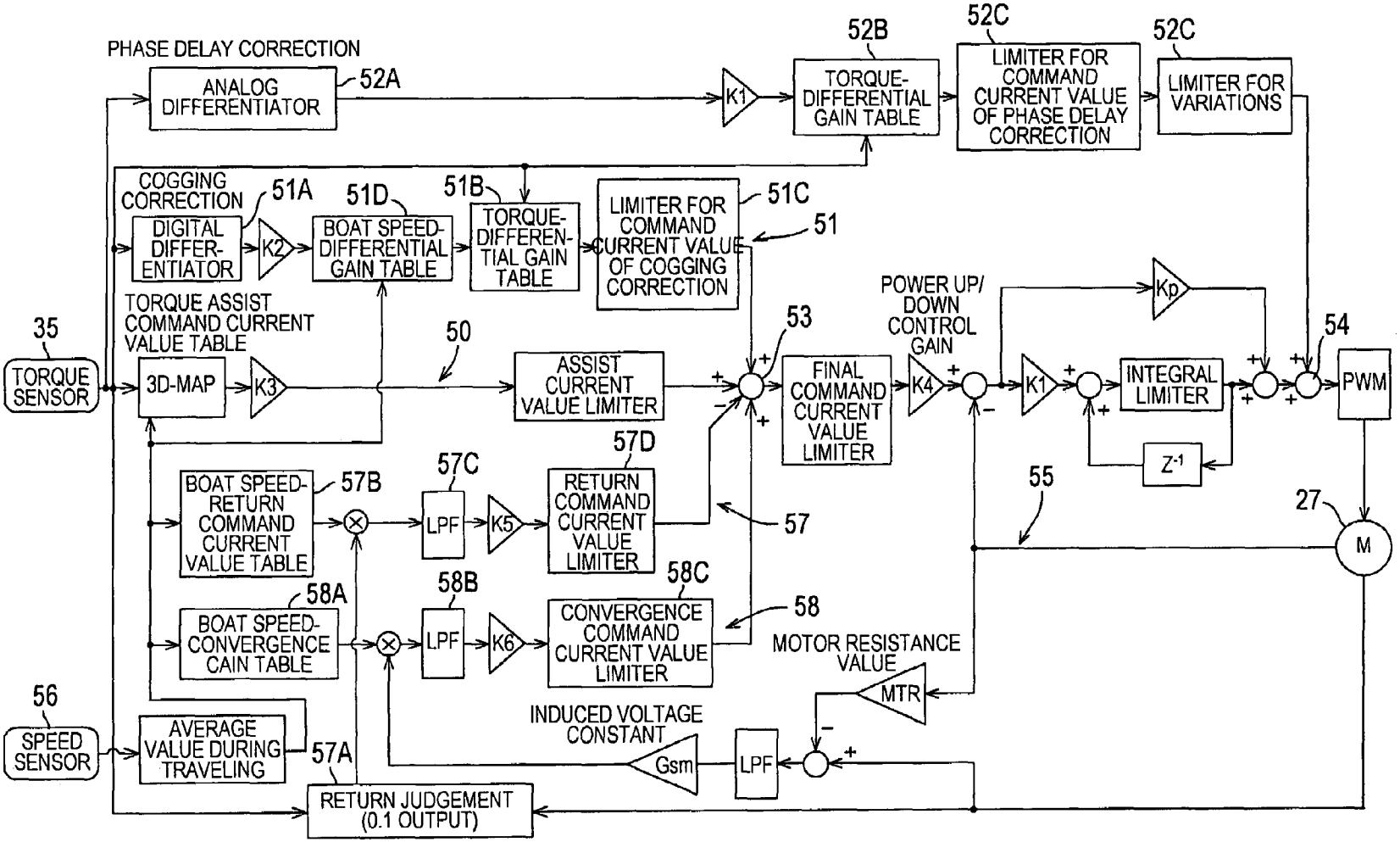
FIG. 10 is another block diagram showing a control system of an electric motor.
Figure 11:
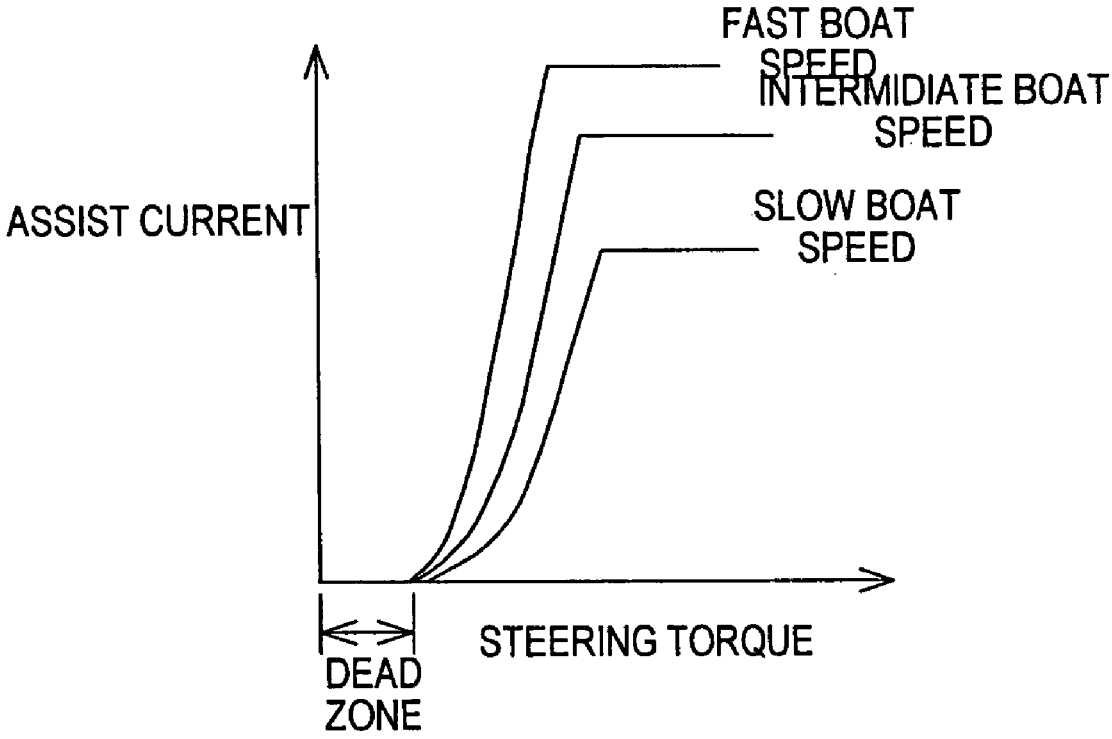
FIG. 11 is a characteristic graph showing an assist characteristic by a basic assist current value in FIG. 10.

FIG. 10 is a block diagram showing an ECU 3 to change characteristics of a first basic assist current value in accordance with a boat speed. The basic assist current determination process 50 of the preferred embodiment determines an assist current value based upon an averaging speed signal by a speed sensor 56 as shown in FIG. 11. In detail, an assist current is the smallest in the range of a slow boat speed. As the boat speeds up, the assist current increases. According to such assist characteristics, an assist current supplied to the electric motor 27 in relation to a steering torque is increased based upon a boat speed increase, so that a boat can be steered with the same steering torque regardless of a boat speed.

Note that in the case of a small boat having one screw only, the travel direction of the boat is inclined to be biased to either direction of the right and left directions caused by the rotation direction of the one screw. This inclination is strengthened by a boat speed increase. In such a case, the assist characteristics are required to change in a way that the assist force in the biased side is weakened in accordance with the boat speed increase and on the other hand, the assist force in the other side is strengthened with the boat speed increase. A steering torque is also affected by an engine speed, a trim angle of the outboard motor 6, and a size of a boat. Therefore, these conditions are received by sensors or switches or the like and an assist amount optimal for each condition inputted in advance is automatically set or selected.

And the speed signal is also inputted to the auxiliary assist current determination process 51 to be multiplied by a differential gain at a gain table 51D to correct a correction output value of the auxiliary current determination process 51 by a boat speed. A differential gain varies with a magnitude of a speed signal to restrict occurrence of vibrations of the correction output value.

Further, the speed signal is inputted also to a return control process 57 and a convergence control process 58. That is, for example when the steering wheel is returned to a straight state by changing it to the steering in the right direction in order to change the boat direction from the steering in the left direction to the straight direction, there occurs the resistance to the return of the steering wheel 2 to the straight state due to friction and inertia of the electric motor 27. The return control process 57 improves this return operation of the steering wheel 2. Therefore, an assist current is added in the rotation direction (the direction of self aligning torque) to the electric motor 27 in returning the steering wheel 2 to assist the returning of the steering wheel 2.

In detail, a voltage between terminals of the electric motor 27 (rotation direction of the electric motor 27) and a steering torque (rotation direction of the steering wheel 2) are compared to judge whether the steering wheel 2 is in the turn state or the return state (57A). In the case of the return state of the steering wheel 2, a return command current value set in advance at a table 57B in accordance with a speed signal is processed at a low pass filter 57C and at a limiter 57D so that the output value does not change rapidly or become excessive. The first basic assist current value decreases or increases the processed return command current value corresponding to the rotation direction of the electric motor 27. The steering wheel 2 is assisted in the return direction based upon the corrected first basic assist current value. Note that it is preferable that the return control process 57 includes a dead zone for preventing chattering at a changing point between the turn and return states of the steering wheel 2.

With regard to the convergence control process 58, in case a single outboard motor is used as a steering unit, a steering force is produced in the same direction with the rotation direction of the propeller 13 viewed from the rear side of the boat, caused by an increase of a propeller speed. Therefore, if the steering wheel 2 is not gripped by a coxswain, the steering wheel 2 tends to be forcibly turned by the steering force. And when the return speed of the steering wheel 2 becomes too faster, a steering amount tends to be excessive due to inertia of the electric motor 27 and the steering wheel 2 (overshoot). The convergence control process 58 performs controls to solve such problems.

Particularly, firstly, a convergence gain in advance set based upon a speed signal at a table 58A is multiplied by a rotation speed of the electric motor 27 to determine a convergence current value. The low pass filter 58B and the limiter 58C limit the determined convergence current value so that the determined convergence current value does not change rapidly or become excessive. And the first basic assist current value is subtracted by the convergence current value to restrict the excessive increase of the rotation speed of the electric motor 27.

In the steering system for the small boat provided with the above-mentioned construction, the steering operations are performed according to the following process order.

1. The steering wheel 2 is steered from a neutral position to, for example to the right or the left position.

2. As a result, the steering shaft 23 and the torque ring 30 rotate in the right or the left direction to rotate the output shaft 22 through the torsion bar 24 in the right or the left direction.

3. The pump unit 5 discharges hydraulic oil from one port 20A (or the other port 20B).

4. The hydraulic oil is supplied as an operating oil through the hydraulic pipe 9 to the right or the left side cylinder chamber 8A (8B) toward the forward direction.

5. On the other hand, the operating oil in the left (right) side cylinder chamber 8B (8A) is sucked in the pump unit 5 through the hydraulic pipe 9 from the other port 20B (or one port 20A).

6. The piston rod 7C is expanded in the left (right) side toward the forward direction to rotate the steering bracket 16 in the counter clockwise direction (clockwise direction) through the drag link 17.

7. As a result, a moment in the right turn (left turn) acts on the boat body 1, and the boat body 1 advances while turning in the right direction (left direction).

In the above steering, the torsion bar 24 is twisted in accordance with a steering force and this torsion changes the position of the torque ring 30 in the axial direction in accordance with the torsion direction of the torsion bar 24. This position change of the torque ring 30 moves the detecting pin 36, which is detected as a steering torque by the torque sensor 35. The detected steering torque is inputted to the ECU 3. In the ECU 3, as described above, the basic assist current is determined, and the auxiliary assist current determination processes 51, 52, and the auxiliary assist current addition processes 53, 54, are performed. And the electric motor 27 is driven by the driver PWM,. as well as the feedback process is performed to assist the steering of the steering wheel 2.

Note that in the above preferred embodiment, it is explained that the in-line axial plunger pump 21 is used as the pump unit 5 to supply and discharge an operating fluid metered in accordance with a steering amount, but a displacement type pump, such as an angled pump, a gear pump, a vane pump, or the like may be used (not shown).

Figure 12:
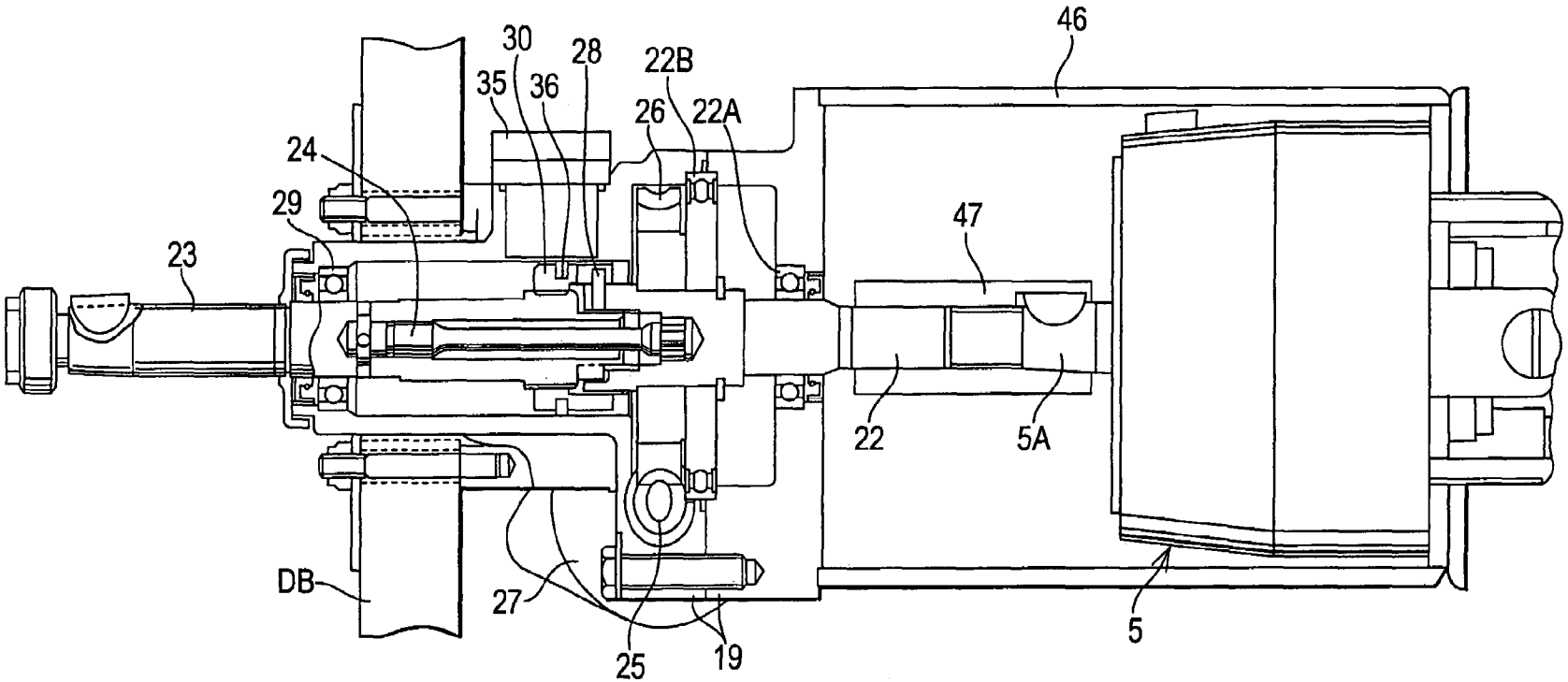
FIG. 12 is a cross sectional view showing a power-assisted unit and a pump unit for a steering system in a second preferred embodiment.

And in the above preferred embodiment, the cases 19 of the power-assisted unit 4 and the pump unit 5 are integrated and the output shaft 22 drives the rotor 37 of the pump unit 5. However, as shown in FIG. 12, an extension tube 46 housing the pump unit 5 may be disposed in the gear case 19 of the power-assisted unit 4. And the input shaft 5A of the pump unit 5 housed in the tube 46 is connected through a coupling 47 to the output shaft 22. In this case, the pump unit 5 can be added to the power-assisted unit 4 without the pump unit 5 later.

The following effects can be achieved according to the controller 3 of the preferred embodiment. Namely, according to the preferred embodiment, the controller 3 is provided with a basic assist force determination section 50 to calculate a basic assist force signal of an electric actuator (electric motor 27) in accordance with a detection signal of the torque sensor 35, a servo amplifier process section to output a final assist force signal of the electric motor 27 in accordance with the basic assist force signal, and an auxiliary assist force determination section 51, 52 to differentiate a detection signal of the torque sensor 35 for outputting the differential component, thereby to output a correction signal for restricting variations of the assist force of the electric motor 27. Accordingly, the output variations due to the cogging torque or the phase delay of the electric motor 27 are restricted to enhance the steering feeling.

And the basic assist force determination section 50 is provided with an output characteristic change section which includes a plurality of output characteristics of the basic assist force signal and selects any one of them or changes an output characteristic of the basic assist force signal, to change the output characteristic of the basic assist force signal in accordance with a propelling state such as an external switch 49, a speed sensor 56 or the like. As a result, an optimum steering feeling in accordance with traveling conditions such as a speed of a small boat can be obtained.

Further, the auxiliary assist force determination sections 51, 52 are arranged in such a way that a correction signal is added to at least one of a basic assist force signal and a final assist force signal to restrict variations of the assist force of the electric motor 27. Accordingly, the correction signal is not canceled by an integral process at the servo amplifier process section and is added to the final assist force to restrict assist variations of the electric motor 27 effectively.

And the controller 3 is provided with the return control section 57 that judges a return state of the steering wheel 2 based upon an output signal of the torque sensor 35 and a rotation direction of the electric motor 27, to increase the basic assist force signal in the return direction. Accordingly, when, in order to change the boat direction from the left steering to the straight state, the steering wheel 2 is returned to the straight state by turning it in the right steering (or the reverse case), there occurs the resistance to the return of the steering wheel 2 due to friction or inertia of the electric motor 27, but the return control section 57 can improve this problem.

And the controller 3 is provided with the convergence control section 58 to restrict a basic assist force signal in accordance with an operating speed of the electric motor 27. Accordingly, a damping (braking) force acts on the steering of the steering wheel 2 to provide an appropriate steering feeling.

And output signals of the return control section 57 and the convergence control section 58 are adjusted in accordance with a boat speed. Accordingly, the steering feeling of the steering wheel 2 can be appropriately set in accordance with speeds or the like of a small boat.

Further, according to the preferred embodiment, a pump unit is provided to drive a cylinder unit that rotates a steering unit in a rear side of a boat body, the cylinder unit being driven through a hydraulic pipe by a steering wheel in a driver's seat, wherein a torque sensor detects a steering torque inputted to the pump unit from the steering wheel to assist-drive the pump unit in the steering direction by the electric actuator. Therefore, the electric actuator or the torque sensor can be disposed accompanied by the steering shaft and the pump unit that are operated directly by the steering wheel in a driver's seat, and it is not necessary to take into account intrusion of water scattered from a propeller of an outboard motor as a steering unit, namely there is no factor to increase the product cost for improvement of the water proof property to provide an inexpensive steering system.

And also the torque sensor does not include friction such as a wire or the like, and can detect a steering torque accurately because of a direct sensing of the steering force of a coxswain. And the steering force of a coxswain can be reduced by increasing an assist force of the electric motor driven based upon the calculation of the ECU. And also the friction component is not included, whereby the steering feeling of a coxswain can be improved. And the pump unit serving as a measurement pump and the cylinder unit disposed in the rear side of the boat body are hydraulically connected by the hydraulic pipe, and therefore, the friction generated in a wire or the like is not included. Accordingly, a transmission efficiency of the steering force is high, and the energy loss is low.

And since the pump unit, the torque sensor, and the electric actuator are assembled integrally, the steering system can be produced further inexpensively and easy to handle.

Further, since the electric actuator is connected to the pump unit via the clutch unit, the electric actuator can be separated from the clutch unit to be in a free state. Accordingly, at the failure of the electric motor or the power source, disengagement of the clutch unit allows the electric motor not to apply a load to the steering wheel operation, and the steering wheel operates the pump unit, the hydraulic pipe, and the cylinder unit to manually steer the steering unit.

This application claims priority to Japanese Patent Application No. 2004-039287. The entire disclosure of Japanese Patent Application No. 2004-039287 is hereby incorporated herein by reference.

While only the selected preferred embodiments have been chosen to illustrate the present invention, it will be apparent to those skilled in the art from this disclosure that various changes and modifications can be made therein without departing from the scope of the invention as defined in the appended claims. Furthermore, the foregoing description of the preferred embodiments according to the present invention is provided for illustration only, and not for the purpose of limiting the invention as defined by the appended claims and their equivalents.

What is claimed is:

1. A steering system for a small boat, comprising:

a steering apparatus disposed in a rear side of a boat body to rotate around an upward and downward axis;

a cylinder unit arranged in the rear side of the boat body to rotate the steering apparatus;

a pump unit steered by a steering wheel;

a pipe to communicate the pump unit with the cylinder unit;

a torque sensor to detect a steering torque inputted from the steering wheel to the pump unit;

an electric actuator to assist-drive the pump unit; and a controller to drive the electric actuator in accordance with a steering direction based upon a detection signal of the torque sensor.

2. The steering system for the small boat according to claim 1, wherein:

the pump unit, the torque sensor, and the electric actuator are assembled integrally.

3. The steering system for the small boat according to claim 1, wherein:

the electric actuator is connected through a clutch unit to the pump unit.

4. The steering system for the small boat according to claim 1, wherein:

the controller comprises:

a basic assist force determination section to calculate a basic assist force signal of the electric actuator in accordance with the detection signal of the torque sensor;

a servo amplifier process section to output a final assist force signal of the electric actuator in accordance with the basic assist force signal; and an auxiliary assist force determination section to differentiate the detection signal of the torque sensor for outputting the differential component, thereby to output a correction signal for restricting variations of an assist force of the electric actuator.

5. The steering system for the small boat according to claim 4, wherein:

the basic assist force determination section comprises:

an output characteristic change section which includes a plurality of output characteristics of the basic assist force signal to select any one of the plurality of the output characteristics or changes an output characteristic of the basic assist force signal, wherein:

the output characteristics of the basic assist force signal are changed by an external switch or in accordance with a boat speed.

6. The steering system for the small boat according to claim 4, wherein:

the auxiliary assist force determination section adds the correction signal to at least one of the basic assist force signal and the final assist force signal to restrict variations of the assist force of the electric actuator.

7. The steering system for the small boat according to claim 2, wherein:

the electric actuator is connected through a clutch unit to the pump unit.

* * * * *